US006304033B1

(12) United States Patent
Grote et al.

(10) Patent No.: US 6,304,033 B1
(45) Date of Patent: Oct. 16, 2001

(54) ELECTRON BEAM TUBE HAVING A DC POWER LEAD WITH A DAMPING STRUCTURE

(75) Inventors: Stefan Grote, Slaters Ville, RI (US); Bernd Seidel, Ahrensburg (DE)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 08/342,327

(22) Filed: Nov. 18, 1994

(30) Foreign Application Priority Data

Dec. 18, 1993 (DE) ..... 43 43 423

(51) Int. Cl.[7] ..... H01J 25/04

(52) U.S. Cl. ..... 315/5.37; 315/5.33; 313/293; 313/447

(58) Field of Search ..... 315/5.33, 5.37; 330/44, 45; 313/293, 447

(56) References Cited

U.S. PATENT DOCUMENTS

| | | | | |
|---|---|---|---|---|
| 2,353,742 | * | 7/1944 | McArthur | 315/5.33 X |
| 2,485,400 | * | 10/1949 | McArthur | 330/45 |
| 2,579,820 | * | 12/1951 | Haller et al. | 330/45 X |
| 2,641,658 | * | 6/1953 | Preist | 333/227 X |
| 2,895,076 | * | 7/1959 | Stocker | 315/39 X |
| 3,622,918 | | 11/1971 | Ito et al. | 333/182 |
| 3,727,098 | | 4/1973 | Crapuchettes | 315/39.51 |
| 4,119,921 | * | 10/1978 | Warringa et al. | 330/45 X |
| 4,146,854 | * | 3/1979 | Ishino et al. | 333/81 R |
| 4,527,091 | * | 7/1985 | Preist | 315/5.37 X |
| 4,760,312 | * | 7/1988 | Watanabe et al. | 315/39 X |

FOREIGN PATENT DOCUMENTS

| | | | |
|---|---|---|---|
| 2259708 | 3/1993 | (GB) . | |
| 4073841 | 3/1992 | (JP) | H01J/23/20 |
| 9424690 | 10/1994 | (WO) | H01J/23/36 |

* cited by examiner

*Primary Examiner*—Bennt T. Lee

(57) ABSTRACT

An electron beam tube (1) having an input resonator cavity (2) through which a high-frequency control voltage is applied between cathode (15) and grid (17) of the tube (1), while an annular electrode (8) connected in an electrically conducting manner to the grid (17) of the tube is arranged opposite a metal wall (9) of the input resonator cavity (2) and is connected to a DC power supply lead (11). Interference oscillations are suppressed in that a high-frequency damping material (14) is associated with the DC power supply lead (11) on a part of the length located proximate to the annular electrode.

7 Claims, 1 Drawing Sheet

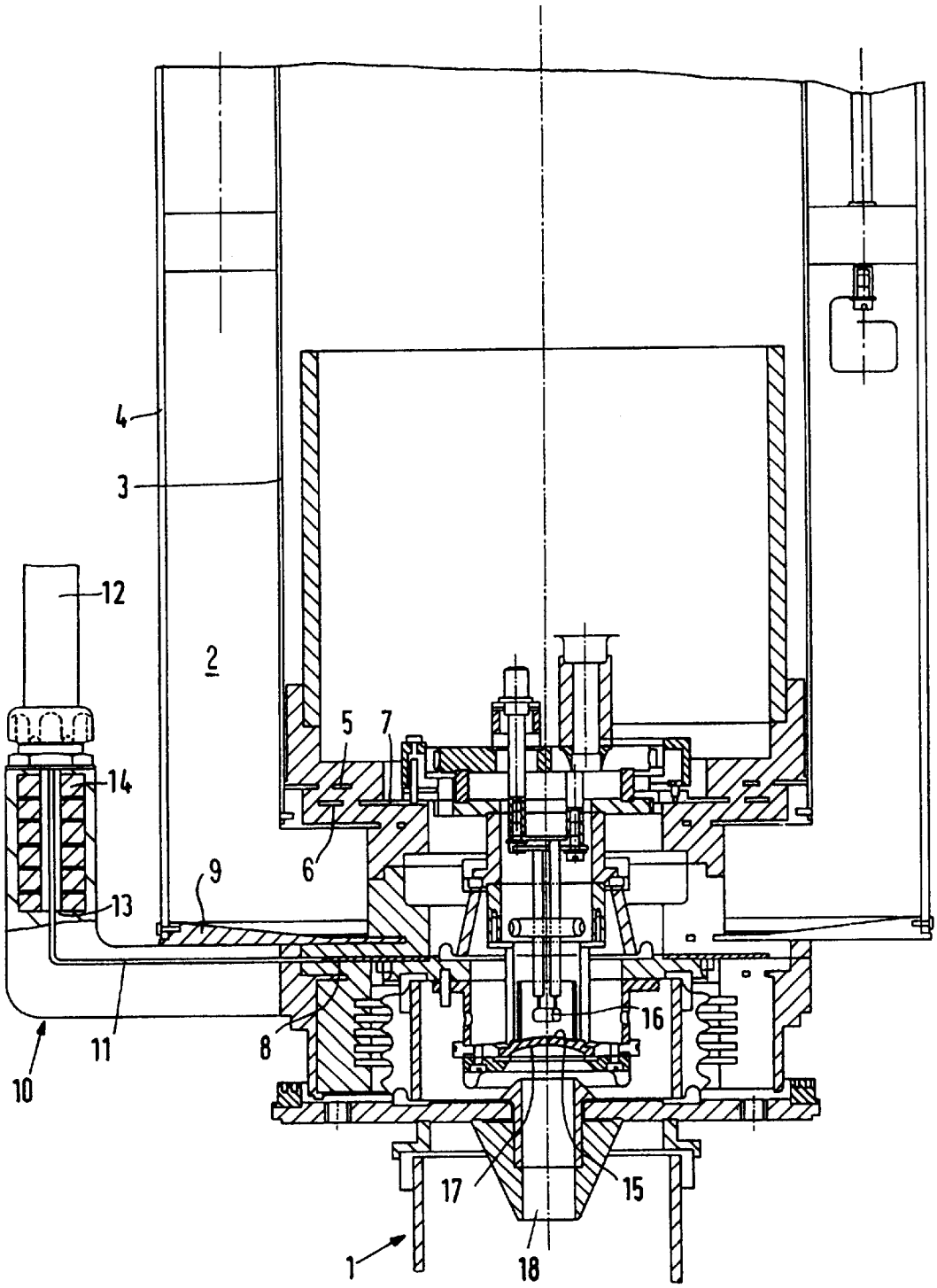
4
3
12
2
5
7
14
6
9
13
11
8
16
10
17
15
1
18

ELECTRON BEAM TUBE HAVING A DC POWER LEAD WITH A DAMPING STRUCTURE

BACKGROUND OF THE INVENTION

The invention relates to an electron beam tube having input resonator cavity through which a high-frequency control voltage is applied between cathode and grid of the tube, while an annular electrode connected in an electrically conducting manner to the grid of the tube is arranged opposite a metal wall of the input resonator cavity and is connected to a DC power supply lead.

Such an arrangement is described in GB-A 2 259 708. In the arrangement described in this document a ceramic material cylinder enclosing a cathode, an anode and a grid is surrounded by a coating of silicon rubber comprising ferrite particles. Self-oscillations of a resonant circuit present between the anode and the grid are prevented thereby. Such self-oscillations may also occur between the cathode and the grid and then cause interference modulation of the electron beam, and in extreme cases may even lead to destruction of the tube.

It was found that disturbing self-oscillations occur in spite of the measures taken in the known case.

SUMMARY OF THE INVENTION

It is therefore an object of the invention to provide more effective measures for suppressing interference oscillations in an arrangement of the type described in the opening paragraph.

This is achieved in that high-frequency damping material is associated with the DC power supply lead on a part of the length located proximate to the annular electrode.

The invention is based on the recognition that resonant circuits whose resonance frequencies are in the range up to approximately 100 kHz are also formed by the inductance of the DC power supply lead in connection with capacitances which are inherent in tubes. These interference oscillations are damped by means of known high-frequency damping materials such as particularly ferrite or silicon carbide. The electric energy of the high-frequency field is absorbed by magnetic resonance or by a high dielectric loss factor in the high-frequency damping material.

A very effective damping is achieved in that the high-frequency damping material coaxially surrounds the part of the length of the DC power supply lead.

In a preferred, constructively favourable and effective solution, the high-frequency damping material is provided in a DC connection support of an input resonator arrangement.

Since the high-frequency damping material comprises a plurality of annular elements, the required quantity of damping material or the number of required ferrite rings can easily be adapted to any tube.

These and other aspects of the invention will be apparent from and elucidated with reference to the embodiments described hereinafter.

BRIEF DESCRIPTION OF THE DRAWING

In the drawing the FIGURE shows, partly in a cross-section, a side elevation of an arrangement according to the invention.

DESCRIPTION OF THE PREFERRED EMBODIMENT

Only the cathode-sided part of an electron beam tube 1 is shown by way of the cathode 15, the cathode filament 16, the grid 17 and a drift space 18. An arrangement having an input resonator cavity 2 is mounted on this end of the tube 1. A metal wall 3 of the input resonator cavity 2 is capacitively coupled via electrically connected metallic annular discs 5 and 6 to an interposed metallic annular disc 7 which is in electrical contact with the cathode 15 of the tube 1.

A metallic annular electrode 8 which is in electrical contact with the grid 17 of the tube is capacitively coupled to a metallic annular wall 9 which is electrically connected to the metal wall 4.

The arrangement constituting the input resonator cavity 2 has a bent DC voltage connection support 10 through which a grid connection lead 11, which is in contact with the metallic annular electrode 8, is passed and which is connected to the DC voltage lead 12.

A part of the length of the grid connection lead 11 is surrounded by six high-frequency damping ferrite rings 14 via an interposed insulating coating 13.

Alternatively, the rings 14 may also consist of silicon carbide. Instead of a plurality of ferrite rings, a single ferrite cylinder may alternatively be used. It is also possible to realise the functions of the insulating coating and the ferrite rings by means of a single structure which consists of, for example silicon rubber containing ferrite particles or silicon carbide particles.

What is claimed is:

1. An electron beam tube comprising a cathode and a grid arrangement for producing an electron beam and means for applying electrical power and electrical signals to said arrangement, said means comprising:

a. an input resonator cavity defined by conductive spaced-apart first and second wall means for applying high-frequency signals to the cathode and grid arrangement;

b. an annular electrode conductively connected to the grid and disposed opposite one of the conductive first and second wall means for capacitively coupling said one of the conductive first and second wall means to the grid;

c. an electrical lead conductively connected to the annular electrode for applying DC power to the grid; and d. high-frequency damping material disposed adjacent a length of the electrical lead which is proximate the annular electrode for inhibiting high-frequency interference oscillations on said electrical lead.

2. An electron beam tube comprising a cathode and a grid arrangement for producing an electron beam and means for applying electrical power and electrical signals to said arrangement, said means comprising:

a. an input resonator cavity defined by conductive space-apart first and second wall means for applying high-frequency signals to the cathode and grid arrangement;

b. means for capacitively coupling the first wall means to the cathode;

c. means for capacitively coupling the second wall means to the grid comprising:

(1) a conductive annular part of the second wall means for defining an end of the cavity; and (2) an annular electrode conductively connected to the grid and disposed opposite the conductive annular part of the second wall means;

d. an electrical lead conductively connected to the annular electrode for applying DC power to the grid; and e. high-frequency damping material disposed adjacent a length of the electrical lead which is proximate the annular electrode for inhibiting high-frequency interference oscillations on said electrical lead.

3. An electron beam tube as in claim 1 or 2 where the high-frequency damping material surrounds said length of the electrical lead.

4. An electron beam tube as in claim 1 or 2 where the high-frequency damping material is disposed within a support for the electrical lead, said support including means for connection to an external lead via which the DC power is supplied.

5. An electron beam tube as in claim 1 or 2 where the high-frequency damping material comprises ferrite.

6. An electron beam tube as in claim 1 or 2 where the high-frequency damping material comprises silicon carbide.

7. An electron beam tube as in claim 1 or 2 where the high-frequency damping material comprises a plurality of stacked annular elements surrounding the electrical lead.

* * * * *